United States Patent [19]

Cook

[11] Patent Number: 4,498,887

[45] Date of Patent: Feb. 12, 1985

[54] SHIFTING MECHANISM FOR TOY VEHICLE

[75] Inventor: John S. Cook, Redondo Beach, Calif.

[73] Assignee: Mattel, Inc., Hawthorne, Calif.

[21] Appl. No.: 486,622

[22] Filed: Apr. 20, 1983

[51] Int. Cl.[3] ..... A63H 29/20

[52] U.S. Cl. ..... 446/462; 446/466

[58] Field of Search ..... 46/201, 206, 209, 212, 46/262, 263; 446/457, 466, 462, 463, 443, 442, 448

[56] References Cited

U.S. PATENT DOCUMENTS 4,141,256 2/1979 Wilson et al. ..... 74/64

FOREIGN PATENT DOCUMENTS 340103 9/1921 Fed. Rep. of Germany ..... 446/462

404465 10/1924 Fed. Rep. of Germany ..... 446/462

662484 7/1938 Fed. Rep. of Germany ..... 446/443

1218211 12/1959 France ..... 446/442

*Primary Examiner*—F. Barry Shay

*Attorney, Agent, or Firm*—Ronald M. Goldman; James G. O'Neill; Max E. Shirk

[57] ABSTRACT

A toy vehicle (11) having a motor drive mechanism (31) with a gear shift lever (28) actuable from a first position (A) to a second position (H) for changing the movement thereof. The vehicle has a pivotable linkage arm (35) with a gear sector (47) having a plurality of teeth (39) connected thereto coacting with a worm gear (37) rotatable in response to vehicle travel for pivoting a trigger finger (56) against the gear shift lever (28) for automatic movement of the gear shift lever from the first position (A) to the second position (H).

10 Claims, 10 Drawing Figures

11
49
31
33
58
53
39
47
12
35
19
28
59
29
61
14
43
63
41
21
25
74
45
37
29
25
23
27
26

49
21
39
47
35
14
11
17
12
53
29
57
71
37
51
55
65
31
45
56
28
33
67
25
29
43
69
23
19

11
31
75
33
63
58
53
12
35
47
39
28
59
61
56
77
41
43
14
19
26
74
21
29
45
37
29
76
23
27
25
25

49
21
47
17
14
43
35
12
53
73
29
51
57
45
37
31
35
55
28
33
29
43
25
56
19

SHIFTING MECHANISM FOR TOY VEHICLE

DESCRIPTION

1. Technical Field

This invention relates to toy vehicles and more particularly to an improved automatic shifting mechanism for a toy vehicle having a two-speed motor shifted by a gear shift lever.

2. Background Art

Toy vehicles have been a constant source of amusement for children; particularly when the vehicle has different modes of movement. One such toy vehicle is shown and described in U.S. Pat. No. 3,772,824, issued Nov. 20, 1973. In this patent the vehicle mechanism is capable of performing "spinning", "rocking" and other motions. In other toy vehicles, two-speed motor mechanisms are provided for enabling the user to pre-select a gear ratio, and ultimately control the speed of movement of the vehicle. One elaborate mechanism, which also includes a reverse mode, is shown in U.S. Pat. No. 2,257,064, issued Sept. 23, 1941. Another such vehicle is shown and described in U.S. Pat. No. 4,116,084 issued Sept. 26, 1978. The latter vehicle has a pair of depressable push-buttons extending through the roof. By pressing either button, a rocking plate is moved above a pivot for changing gears. U.S. Pat. No. 4,059,918 issued Nov. 29, 1977 illustrates a toy vehicle having a control lever which may be actuated to a "forward" or "reverse" position for selecting the direction of travel of the vehicle.

Other toy vehicles having shiftable drive mechanisms are shown and described in U.S. Pat. Nos. 4,135,328 and 4,141,256, issued Jan. 23, 1979 and Feb. 27, 1979, respectively, both of these patents being assigned to Mattel, Inc., the assignee of the present invention.

Finally, pending U.S. patent application Ser. No. 345,297, filed Feb. 3, 1982 and assigned to Mattel, Inc., the assignee of the present invention discloses a toy vehicle having a control arm for effecting vehicle speed changes. This vehicle includes a pivotable linkage arm having one end adapted to engage cam means for pivoting the linkage arm in response to movement of the toy vehicle a certain distance. The other end of the linkage coacts with the control arm to effect movement thereof as the linkage pivots, with movement of the control arm actuating the motor means to a different mode for effecting changes in vehicle speed. The linkage arm includes a pointed cam follower engaging a spiral groove on a disk secured to the front wheel of the vehicle. Rotation of the wheel moves the cam follower radially. The linkage arm pivots in response to this motion to move the control arm from a notched position, under the force of a spring, to an opposite position to change the gear coupling on a two-speed motor.

However, none of the above discussed prior art discloses an automatically actuated gear and follower means adjacent the front, non-driving wheel or wheels of a vehicle for shifting of the toy vehicle during movement of the vehicle, and which also allows the inertia motor of the vehicle to rev up to a desired speed, without causing premature actuation of the shifting mechanism.

DISCLOSURE OF THE INVENTION

In accordance with the present invention, an improved automatic shifting mechanism for a toy vehicle is provided. The shifting mechanism actuates a gear shift lever to effect gear changes during movement of the vehicle through gear means coupled to a front or non driving wheel of the toy vehicle. The shifting mechanism includes a sector gear operatively coupled to a linkage means to actuate the control arm for shifting the drive means of the vehicle.

Further objects, features and advantages of the invention will become apparent upon a reading of the specification, when taken in conjunction with the drawings in which like reference numerals refer to like elements in the several views.

BEST MODE FOR CARRYING OUT THE INVENTION

Figure 1:
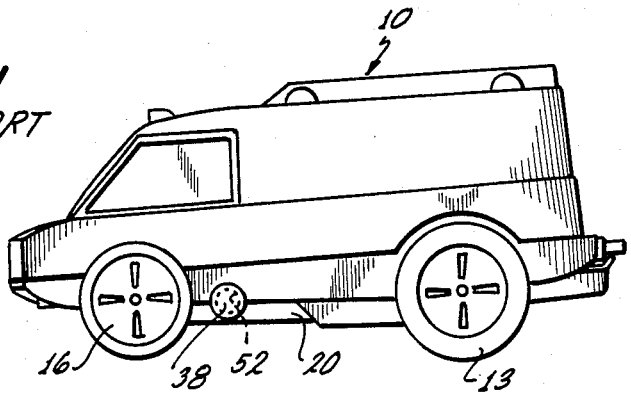
Fig. 1 PRIOR ART
FIG. 1 shows a left side view of a prior art toy vehicle.

Referring now to the drawings, and particularly to FIGS. 1 through 4, the prior art device as disclosed in co-pending U.S. patent application Ser. No. 345,297 filed Feb. 3, 1982 is shown. A toy vehicle 10, having a van type form, includes a pair of rear wheels 12, 13, and a pair of front wheels 15, 16. The rear wheels 12, 13 are assembled with and carried by a motor drive means module 22 which is suitably secured to a chassis member 20 by fastening means (not shown). Extending from the module 22 at the rear end thereof is a control arm 30 having an enlarged cap 32.

The motor drive module 22 is shown and described in U.S. Pat. No. 4,141,256, issued Feb. 27, 1979 to Wilson et. al, entitled "Two-Speed Inertia Motor". This patent is incorporated herein by reference thereto. Basically, as discussed in the Wilson et al patent, the motor module is an inertia powered motor having a cluth member operable by a shift fork member by means of a control arm 30 into engagement with a first or second gear arrangement (or neutral) for providing a first or second speed of movement for a vehicle. The shift fork member is urged in a first direction by a compression spring encircling the shaft on which the fork member is slidably mounted. The control arm 30 is suitably bent to engaged notches in an elongate slot to fix the position thereof by the operator detenting the arm 30 in the appropriate notch for the desired gear.

Figure 3:
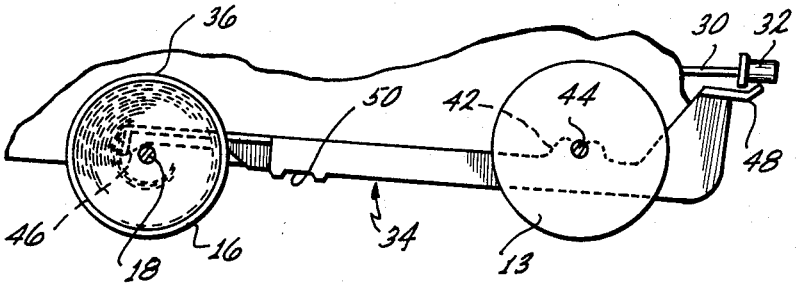
Fig. 3 PRIOR ART
FIG. 3 is a diagrammatic side elevational view showing the operative components of the shifting mechanism of the prior art vehicle of FIG. 1.

The vehicle 10 further includes an actuator means, such as a linkage arm 34, an operating means, such as a cam disk 36 and reset means, such as cam shaft 38. The cam disk 36 is secured to the inner side of the front left wheel 16 and moves upon rotation of the wheel 16, as shown in FIG. 3. The interior surface of cam disk 36 is provided with a spiral groove 40, much like the groove on a phonograph record. The linkage arm 34 is provided with an arcuate cutout 42 adjacent the rear end thereof for frictionally, pivotably engaging an axle 44 of the motor module 22. The forward end of the linkage arm 34 is of a length sufficient to terminate in proximity to the cam disk 36, with the forward portion being suitably bent to clear the front wheel 16. The forward portion of the linkage arm 34 is generally blade shaped and bent, with the free end thereof having a cam follower means 46 in the form of a pyramid extending from the side thereof toward the cam disk 36. The point of the pyramid or cam follower 46 is configured for tracking in the spiral groove 40 of the disk 36, similar to a phonograph needle.

Rearwardly of the pivot or cutout 42, the linkage arm 34 extends back and up, terminating in a trigger foot 48, which is of a bent plate-shaped configuration for abuttingly engaging the cap 32 of the control arm 30 of the motor module 22. A downwardly depending cutout 50 is provided on the linkage arm 34 intermediate the pivot or cutout 42 and the cam follower 46. A reset button or cam shaft 38 is inserted through an aperture 52 in the side of chassis member 20, with the lead end having a ramped notch 54 for captively and slidably engaging the depending cutout 50 of the linkage arm 34. The cam shaft 38 is slidable within the aperture 52 with the lower edge of the cutout 50 coacting with the ramp of the ramped notch for presetting the initial amount of pivoting of the linkage arm 34. That is, upon depression of the shaft 38, the front end of the linkage arm 34 will be raised to preposition the cam follower 46 relative to the groove 40 of the cam disk 36.

Figure 2:
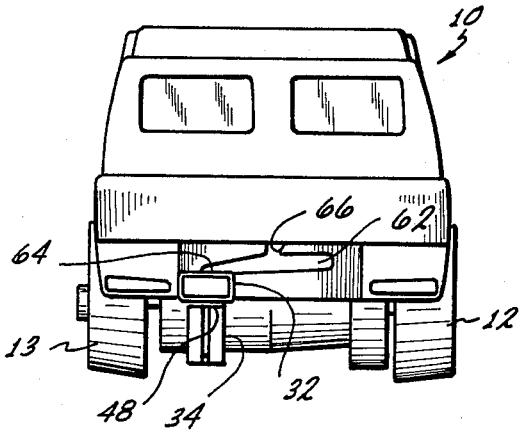
Fig. 2 PRIOR ART
FIG. 2 is an end view of the prior art toy vehicle of FIG. 1.

The control arm 30 is part of an overall shift lever 60 (shown in dotted line in FIG. 4), the arm 30 travelling within a slot 62 (shown in solid line in FIG. 2). The slot 62 has a downwardly depending notch 64 at the left end thereof, with an upwardly extending notch 66 at the midpoint thereof. The notches 64 and 66 are configured to retain the control arm in selected positions against the force of a compression spring 68 within the motor module.

Figure 4:
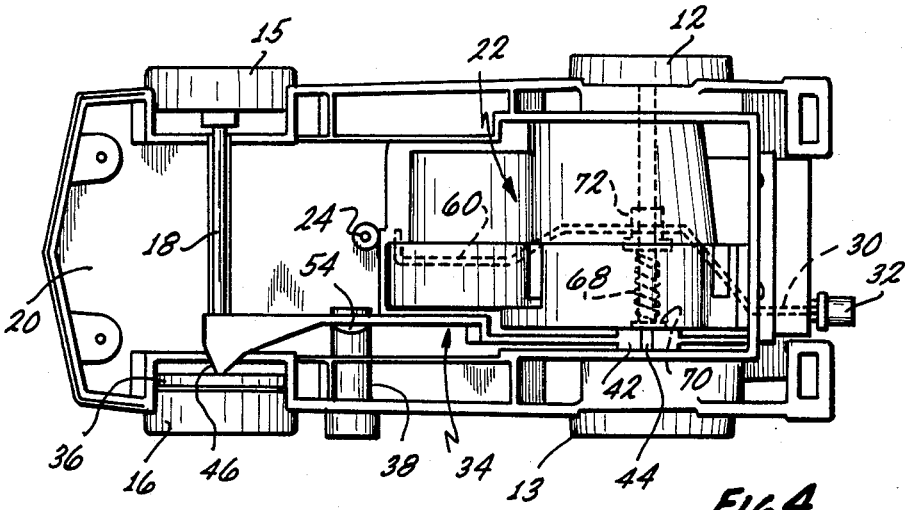
FIG. 4 PRIOR ART
FIG. 4 is a bottom plan view of the prior art toy vehicle of FIG. 1.

The shifting mechanism of the prior art, as specifically shown in FIG. 4, operates as follows: a child holds the vehicle 10 in its hand and depresses the "reset" cam shaft 38 inwardly to thereby cause the ramped notch 54 to urge the linkage arm 34 to pivot upwardly, and slightly outwardly. During this movement the arm 34 pivots with the pointed cam follower lifted away from the spiral groove 40 to reposition it radially, outwardly from the axle 18. Upon releasing the cam shaft 38, the cam follower end 46 is biased into and selects the adjacent position of the groove 40 and seats itself therein. The operator then moves the control arm 30 of the shift lever 60 to the leftmost position, as shown in FIG. 2, and detents the control arm 30 within the notch 64 of the slot 62. This position of the control arm 30 corresponds to the selection of "low" gear. In this position, as shown in FIGS. 1 and 3, the cap 32 of the control arm is in proximate, if not abutting relation with the trigger foot 48. The inertia motor module 22 may then be energized by repeatedly moving the drive wheel 12 over a surface. During this movement, care must be exercised by the operator to avoid contact of the front wheel 16 carrying the cam disk 36, with the surface over which the rear wheels are being displaced. This is to avoid rotation of the wheel 16 which would result in radial displacement of the cam follower end 46 of the linkage arm 34, thus prematurely shifting the mechanism.

Turning now to FIGS. 5–10, there shown is toy vehicle 11 having an improved shifting mechanism generally designated 12. The vehicle includes a chassis 14 with a pair of rear drive wheels 17, 19, and a pair of front wheels 21, 23. The front wheel 21, 23 are fixed at either end of an axle 25 and rotate with the axle. The axle 25 is movably held on the chassis 14 within slotted openings 26 formed on both sides of the chassis in downwardly depending tab portions 27 fixed at the front of the chassis. Any type of exterior body or housing, not shown, such as an open pickup through which a gear shift lever 28 of the shifting mechanism 12 may be reached, may be fixed to the chassis. This body will preferably cover the chassis and be fixed at the rear of the chassis, in any known manner. In addition, the body may be fixed to the front of the chassis by means of screws or the like (not shown), extending upwardly through holes 29 and captured within the body.

The rear or drive wheels 17, 19 are assembled with, and carried by a motor drive means module 31, which is suitably secured to the chassis member 14 in any convenient manner. The motor module includes a forward extending transmission section 33, carrying the gear shift lever 28. The motor drive module 31 is of the inertia motor type, as more fully shown and described in U.S. Pat. No. 4,141,256. This motor module includes a clutch member operated by a shift fork member through the gear shift lever 28. The motor includes, first, second, and neutral gear arrangements for providing a first or second speed of movement of the vehicle. The gear shift lever may be engaged in notches in an elongated slot to fix the position of the gear shift lever by the operator detenting the gear shift lever in the appropriate notch.

The shifting mechanism of the vehicle further includes a linkage arm, generally designated 35 and an operating means, such as a worm gear 37. The worm gear is secured to the front axle 25 for rotation therewith upon rotation of either or both of the front wheels 21, 23. The linkage arm 35 includes actuator means, such as gear teeth 39 formed in a sector 47 at the front thereof for engaging the worm gear 37, when the axle 25 is at the upper end of the slots 26. As is seen more clearly in FIGS. 5 and 7, the forward end of the linkage arm 35 includes a downwardly depending section 41 which extends into a hollowed out portion 43 having a forward, opened section 45 into which the worm gear 37 extends. The gear teeth 39 are carried at the end of the flat planar sector 47, substantially parallel to the upper section of the linkage arm 35. When the gear teeth 39 are engaged with the gear worm 37, and the vehicle is moving in the forward direction, (see arrow 49 in FIGS. 5, 6, and 8) the linkage arm 35 will be rotated in a counterclockwise direction, as shown by arrow 51.

Figure 8:
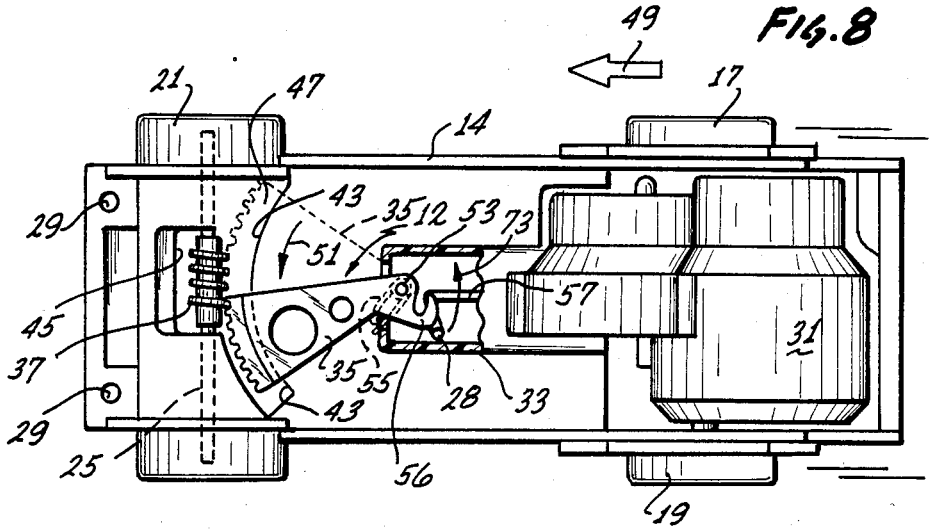
FIG. 8 is a further top plan view of the chassis portion, as shown in FIG. 6, with the linkage arm of the shifting mechanism moved to the operating position to shift the gear shift lever into high gear.

The rear end of the linkage arm 35 is pivotably mounted on a pin 53 held within the transmission section 33. A return spring 55 is mounted about the pin 53 and coacts with the linkage arm 35 or an extending trigger finger portion 56 formed therewith, to normally bias the linkage arm 35 to the rest or start position, as shown in solid line in FIGS. 5-7, 9 and 10, and in broken line in FIG. 8. Finger 56 is configured to engage gear shift lever 28 at the end of the movement of the linkage arm 35, as shown in solid line in FIG. 8. The gear shift lever forms part of an overall shift lever 57. The gear shift lever travels within an elongated slot 58 having a downwardly depending notch 59 at the left end thereof (when looking toward the front of the vehicle), and an upwardly extending notch 61 immediately above it. A further upwardly extending notch 63 is provided at the midpoint of elongated slot 58. Each of the notches 59, 61, and 63 are configured to retain the gear shift lever 28 in the selected position against the force of a compression spring 65 within the motor module (shown in broken line in FIG. 6). The spring 65 encircles a rear axle 67 of the motor module 31 between a washer 69 and a shift fork member 71 which is slidably mounted on the rear axle. The gear shift lever 28 is normally biased in the direction of the arrow 73 (FIG. 8). That is, in the direction toward the end of the elongated slot indicated by the letter H for "high" gear (see FIGS. 5, 7, 9, and 10). This bias is caused by the force of the compression spring 65 against fork 71 and lever 57, which causes the gear shift lever 28 to follow within the slot 58. When the gear shift lever 28 is captured within the notch 63, as shown in FIG. 10, the motor is in "neutral" gear, indicated by the letter N. That is, neither "low" nor "high" gear is engaged.

The operation of the vehicle 11 and shifting mechanism 12 will now be described. By first turning to FIG. 5, it is seen that a person using the vehicle holds the vehicle on a surface, generally indicated at 74. The gear shift lever 28, in order for the vehicle to be automatically shifted, must be placed in and captured or detented in the notch 61. This detented position of the gear shift lever 28 within notch 61 corresponds to automatic "low" gear, as indicated by the letter A. The inertia motor module 31 may now be energized by repeatedly moving the drive wheels 17, 19 over surface 74 to start rotation of the flywheel (not shown) within the inertia motor, in a well known manner. During this movement, the front wheels 21, 23 will also be pressed against the surface, to thereby move upwardly in the slots 26, so that the front axle 25 is pressed against the top end of each of the slots. In this position, the worm gear 37 will engage the teeth 39 of the sector 47 and will commence rotation of the linkage arm 35 each time the vehicle is moved forward. However, each time the vehicle is lifted upwardly, away from the surface 74, (in the direction of the arrow 75, FIG. 7), the weight of the wheels, 21, 23, worm gear 37 and axle 25 will cause the axle to slide to the opposite or lower end of slots 26, (see arrow 76 FIG. 7). This causes the worm gear to be disengaged from the sector teeth 39, thereby allowing the linkage arm 35 to be returned to its starting position (arrow 77), by the biasing action of return spring 55. In other words, although rotation of the front wheels, axle 25 and worm gear 37 will start movement of the linkage arm 35 each time the vehicle is moved over the surface 74 to energize the inertia motor, the lifting of the vehicle after each energization movement will allow the linkage arm to return to the start position.

Figure 5:
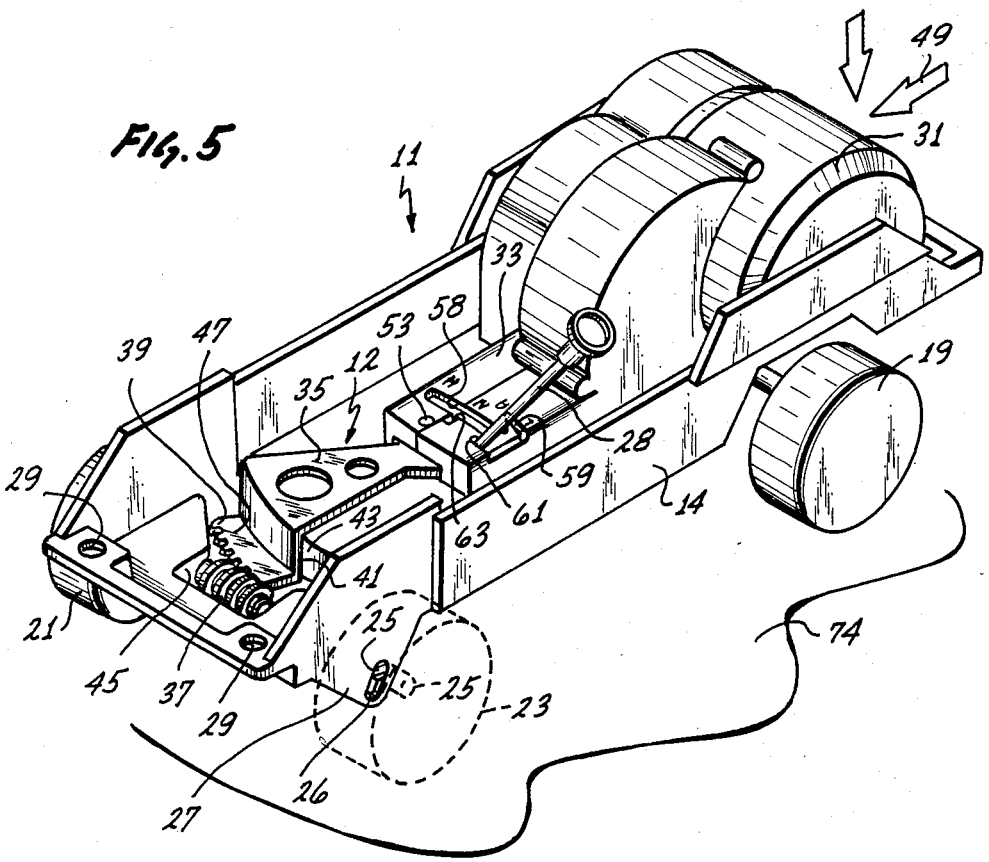
FIG. 5 is a perspective view of the chassis portion of the toy vehicle of the present invention on a surface, illustrating the details of the shifting mechanism.
Figure 6:
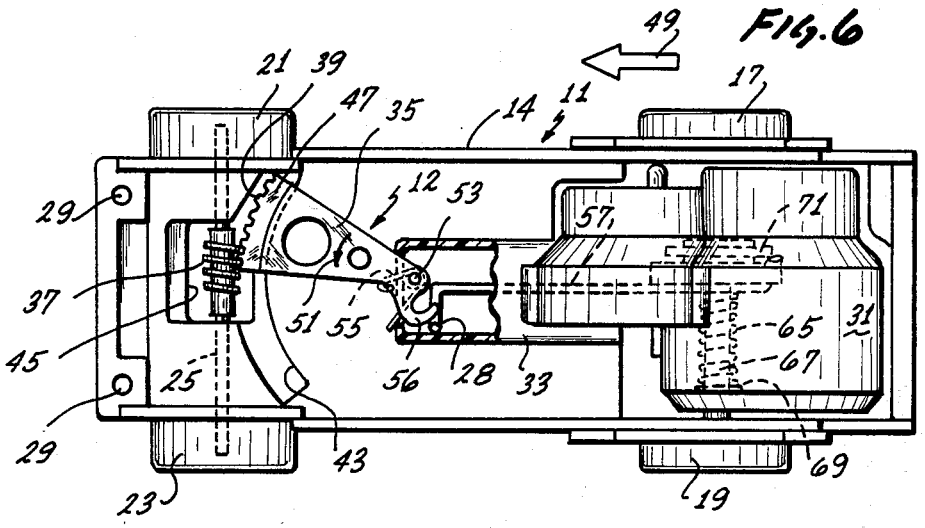
FIG. 6 is a top plan view of the chassis portion of FIG. 5, partly in cross-section.
Figure 7:
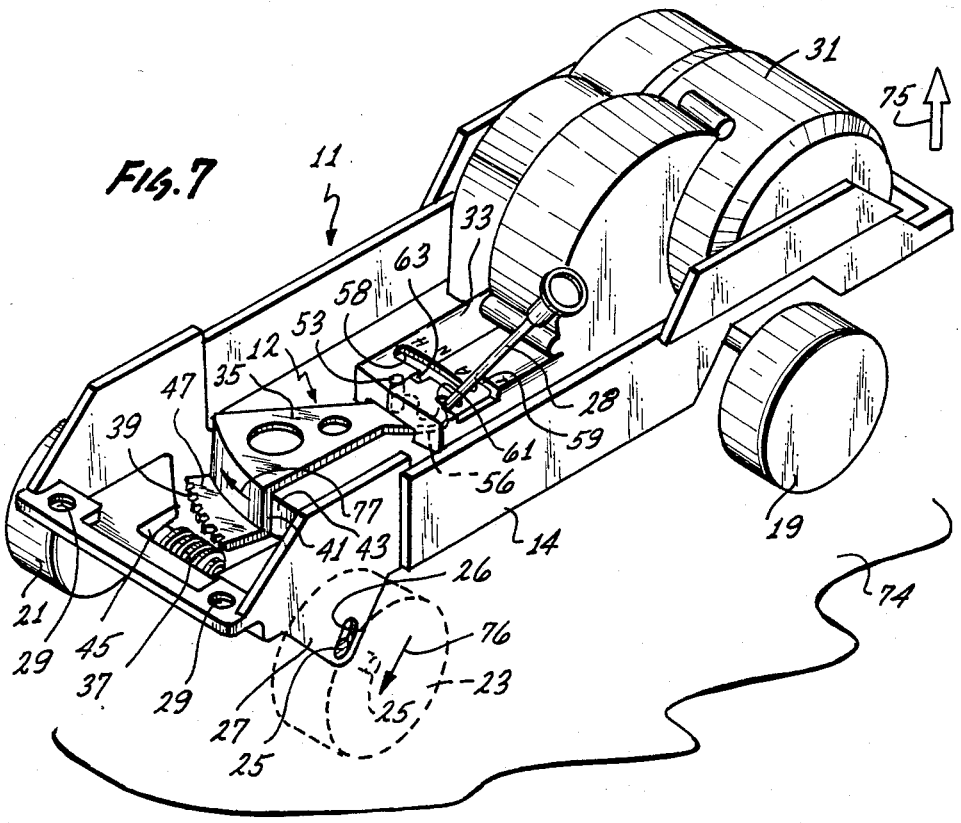
FIG. 7 is a further perspective view of the vehicle as shown in FIG. 5 with the vehicle held above a surface.

After the desired energization of the motor has been achieved, the operator places the toy vehicle on the surface 74 (as shown in FIGS. 5, 6 and 8) to commence forward movement of the vehicle (in the direction of the arrow 49). During this forward movement, the front wheels 21, 23, engaging the surface 74, will rotate and concurrently therewith rotate the worm gear 37 on axle 25. In addition, since axle 25 is at the top of the slots 26, during rotation of the worm gear, the gear sector teeth 39 of linkage arm 35 will be engaged therewith to move the linkage arm in the counterclockwise direction (arrow 51). As the linkage arm 35 rotates in the counterclockwise direction, the finger 56 will eventually rotate into contact with the gear shift lever 28. The gear shift lever will eventually be completely pushed out of detent notch 61 to allow it to move in the direction of arrow 73 (FIG. 8). That is, when the linkage arm 35 has moved to the position shown in solid line in FIG. 8, the gear shift lever 28 will be fully disengaged from detent notch 61 and, under the force of coil spring 65, will be moved to the opposite end of the slot 58, indicated by the letter "H". This position of gear shift lever 28 corresponds to "high" gear.

As a consequence of this movement of gear shift 28, the vehicle 11 commences travel in "low" gear, and after a certain distance, determined by a number of factors, such as the speed of the motor, the number of teeth 39 on sector gear 47, and the size of the worm gear 37, will "automatically" shift into "high" gear, and correspondingly higher speed, thus giving an illusion of real-life movement and shifting of the vehicle.

Figure 9:
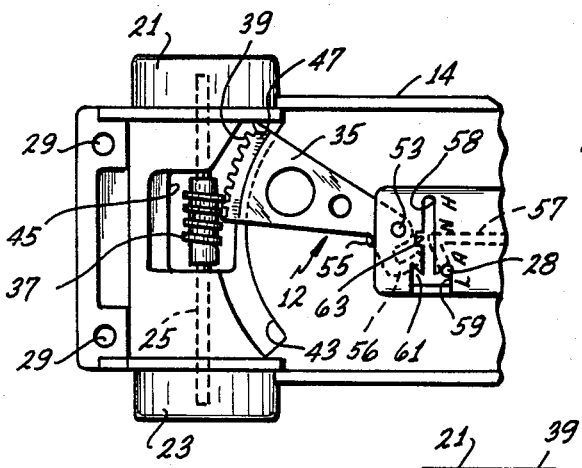
FIG. 9 is a partial top plan view of the chassis portion showing the gear shift lever in low gear.
Figure 10:
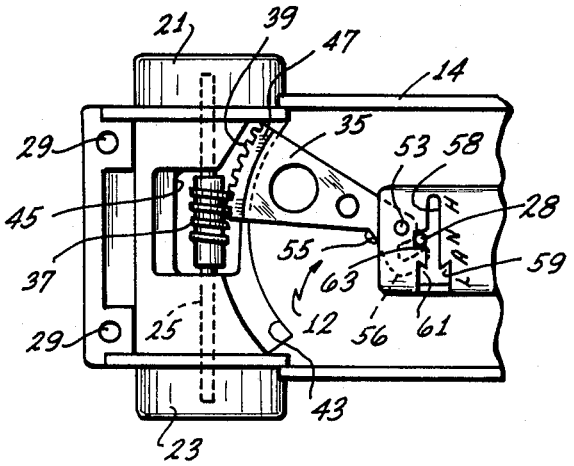
FIG. 10 is a top plan view similar to that of FIG. 9, with the gear shift lever in neutral.

If it is desired to operate the vehicle in "low" gear without having the same being automatically shifted into "high" gear, the gear shift lever 28 is detented into lower notch 59 (FIG. 9). The gear shift lever will remain in this position since finger 56 of linkage arm 35 does not reach and therefore, cannot move the gear shift 28 from this detented position.

While the particular automatic shifting mechanism of the present invention has been described in considerable detail, it is to be understood that this description is merely illustrative of the invention, and that no limitations are intended other than as found in the attached claims.

I claim:

1. In a toy vehicle combination comprising:

vehicle movement changing drive means mounted in said vehicle and responsive to actuation of a gear shift lever mounted in said vehicle from a first position to at least one other position, means in said vehicle for retaining said gear shift lever in said first position against biasing means in said vehicle urging said gear shift lever toward a said other position;

at least one non-driven support wheel member coupled to said vehicle for rotation in response to movement of the vehicle on the surface;

gear means coupled for rotation with said at least one wheel member;

linkage means having a trigger portion configured mounted in said vehicle and positioned for engaging said gear shift lever in said first position; and a gear sector operatively coupled to said linkage means and coacting with said gear means for enabling movement of said trigger portion to enable actuation of said gear shift lever to said at least one other position for effecting vehicle movement changing during travel of said vehicle on a surface.

2. The combination according to claim 1 wherein said gear means is a worm gear coupled to an axle held between two front wheels on said vehicle and wherein said sector gear is coupled to said linkage means.

3. The combination according to claim 2 wherein said vehicle includes a chassis and said front axle is held within an elongated slot to allow movement of said axle and said worm gear coupled thereto, with respect to the chassis.

4. The combination according to claim 3 wherein said gear shift lever is normally biased by said biasing means towards said at least one other position; said vehicle further includes detent means for retaining said gear shift lever in said first position against the force of the bias; and said trigger portion urges said gear shift lever out of engagement with said detent means during pivoting of said linkage arm member for enabling movement of said gear shift lever under force of the bias to said at least one other position.

5. The combination according to claim 4 wherein said gear shift lever travels within an elongate slot; and said elongate slot includes a plurality of detent mean comprising at least two downwardly depending notches and one upwardly depending notch, with said one upwardly depending notch and one of said downwardly depending notches being in aligned relationship at one end of said slot.

6. In a toy vehicle, the combination comprising:

motor drive means mounted within said vehicle, said drive means having at least one drive wheel configured for engaging a surface to propel said vehicle with said motor drive means energized;

a gear shift lever means mounted on said vehicle;

means within said drive means responsive to actuation of said gear shift lever means from a first position to at least one other position for changing the movement of said vehicle means in said vehicle for retaining said gear shift lever in said first position against biasing means in said vehicle urging said gear shift lever toward a said other position;

at least one non-driven support wheel member coupled to said vehicle for rotation in response to travel of said vehicle on a surface;

a worm gear means coupled for concurrent rotation with said at least one non-driven wheel member, said worm gear member additionally being capable of relative linear movement with respect to the chassis of said vehicle; and a linkage arm member pivotably coupled within said vehicle and having a gear sector means containing a plurality of teeth configured and positioned for coaction with said worm gear in one position of said worm gear for rotation with said worm gear to affect pivoting of said linkage arm member in response to rotation of said non-driven wheel member and said worm gear means; said linkage arm member having a trigger finger portion adjacent one end thereof opposite said gear sector means; said trigger finger portion being positioned for actuating said gear shift lever from said first position to said at least one other position during pivoting of said linkage arm member for enabling changing the movement of said vehicle during travel thereof.

7. The combination according to claim 6, wherein said combination further includes elongate slot means depending from the bottom portion of said chassis of said vehicle and wherein said vehicle includes two non-driven wheel members fixedly attached at either end of an axle held within said elongate slot; said worm gear being coupled for rotation with said axle and capable of movement into and out of contact with said gear sector upon movement of said axle within said elongate slot;

8. The combination according to claim 7, wherein said drive means within said means includes speed-changing means operable in response to actuation of said gear shift lever means.

9. The combination according to claim 8 wherein said gear shift lever means is a gear shift lever having spring means normally urging said gear shift lever toward said second position and said gear shift lever is at one end thereof extending through a slotted opening having a plurality of notches therein with one said notches retaining said gear shif lever in said first position against the force of said spring means.

10. The combination of claim 9 wherein said notch for holding said gear shift lever in said first position for automatic shifting thereof is upwardly depending, and said trigger finger portion pivots in a direction to lift said gear shift lever from said notch into said slotted opening for movement of said gear shift lever by the force of said spring means.

* * * * *